US009236701B2

(12) United States Patent
Nabeta et al.

(10) Patent No.: US 9,236,701 B2
(45) Date of Patent: Jan. 12, 2016

(54) METHOD FOR JOINING WIRE ENDS

(75) Inventors: Yasunori Nabeta, Makinohara (JP); Naoki Ito, Makinohara (JP)

(73) Assignee: Yazaki Corporation, Tokyo (JP)

( * ) Notice: Subject to any disclaimer, the term of this patent is extended or adjusted under 35 U.S.C. 154(b) by 311 days.

(21) Appl. No.: 13/816,340

(22) PCT Filed: Jul. 29, 2011

(86) PCT No.: PCT/JP2011/067447

§ 371 (c)(1),
(2), (4) Date: Feb. 11, 2013

(87) PCT Pub. No.: WO2012/029480

PCT Pub. Date: Aug. 3, 2012

(65) Prior Publication Data

US 2013/0139924 A1 Jun. 6, 2013

(30) Foreign Application Priority Data

Aug. 30, 2010 (JP) ..... 2010-192422

(51) Int. Cl.
*H01R 43/02* (2006.01)
*H01R 4/02* (2006.01)

(52) U.S. Cl.
CPC ..... *H01R 43/0207* (2013.01); *H01R 4/027* (2013.01)

(58) Field of Classification Search
CPC .... H01R 43/0207; H01R 4/021; H01R 4/027; B21F 15/08; B21F 27/08; B21F 27/10
See application file for complete search history.

(56) References Cited

U.S. PATENT DOCUMENTS

| | | | |
|---|---|---|---|
| 2003/0038165 | A1 | 2/2003 | Polvi |
| 2010/0096185 | A1 | 4/2010 | Otsuka et al. |

FOREIGN PATENT DOCUMENTS

| | | | |
|---|---|---|---|
| CN | 101681700 | A | 3/2010 |
| EA | 004489 | B1 | 4/2004 |
| JP | 60-175383 | A | 9/1985 |
| JP | 07-41978 | U | 7/1995 |
| JP | 07-192838 | A | 7/1995 |
| JP | 2003-117666 | A | 4/2003 |
| JP | 2009-070769 | A | 4/2009 |
| SU | 182808 | A | 7/1966 |

OTHER PUBLICATIONS

International Search Report for PCT/JP2011/067447, dated Oct. 18, 2011 [PCT/ISA/210].

(Continued)

*Primary Examiner* — Debra Sullivan
(74) *Attorney, Agent, or Firm* — Sughrue Mion, PLLC

(57) ABSTRACT

By a wire end joining method, conductors are integrally joined to each other by applying ultrasonic vibration in a predetermined direction to a conductor bundle obtained by bundling the conductors exposed from a plurality of wires. In a conductor bundle forming process, the conductor bundle is formed by bundling the conductors while interposing metallic foils or plates between the conductors adjacent in a predetermined direction which is an applying direction of the ultrasonic vibration. In an ultrasonic joining process, the conductors are integrally joined to each other by applying the ultrasonic vibration to the formed conductor bundle while pressing the formed conductor bundle in the predetermined direction.

4 Claims, 5 Drawing Sheets

(56) References Cited

OTHER PUBLICATIONS

Written Opinion for PCT/JP2011/067447, dated Oct. 18, 2011 [PCT/ISA/237].
Office Action dated May 16, 2014 issued by the Russian Patent Office in counterpart Russian Patent Application No. 2013114239/07.
Communication from the Russian Patent Office dated Sep. 24, 2014, in a counterpart Russian application No. 2013114239/07.
Communication from the State Intellectual Property Office of P.R. China dated Oct. 10, 2014, in a counterpart application No. 201180041993.1.
Communication from the Japanese Patent Office dated Jul. 15, 2014, in a counterpart Japanese application No. 2010-192422.
Office Action dated May 29, 2014, issued by the Korean Intellectual Property Office in counterpart Korean Application No. 10-2013-7005347.
Office Action dated Apr. 24, 2015, issued by the State Intellectual Property Office of P.R. China in counterpart Chinese Application No. 201180041993.1.
Written Opinion for PCT/JP2011/067447 dated Oct. 18, 2011 [PCT/ISA/237].
International Preliminary report on Patentability for PCT/JP2011/067447 dated Mar. 12, 2013 [PCT/IB/373].

METHOD FOR JOINING WIRE ENDS

TECHNICAL FIELD

The present invention relates to a joining method for joining conductors of a plurality of wires at their ends.

BACKGROUND ART

For example, in a wire harness for a vehicle such as an automobile, etc., an operation for joining conductors of a plurality of insulated wires together has been carried out.

As a technique for joining the conductors of the plurality of wires, there is known a technique of increasing peel strength at a joining region in such a way that conductors exposed from insulated wires are bundled by a metallic foil and then joined by an ultrasonic joining (see PTL 1, for example).

CITATION LIST

Patent Literature

[PTL 1] JP-A-2009-70769

SUMMARY OF INVENTION

Technical Problem

However, as shown in FIG. 9A, in a case where ultrasonic vibration is applied to a bundle 2 of conductors 1 by an ultrasonic joining method and thus the conductors 1 are joined to each other, the ultrasonic vibration is transmitted in one direction from a horn 3 toward an anvil 4. Accordingly, in the ultrasonic joining method, joining strength between the conductors 1 of the wires is large in the direction from the horn 3 toward the anvil 4, but is small in a direction perpendicular to the direction the horn 3 toward the anvil 4.

For this reason, in a case where the conductors 1 of the plurality of wires are joined by the ultrasonic joining method, it is necessary that the ultrasonic vibration is applied one time, as shown in FIG. 9B and then, the bundle 2 of the conductors 1 is rotated by 90 degrees and then the ultrasonic vibration is again applied to the bundle 2 of the conductors 1 in a different direction by 90 degrees, as shown in FIG. 9C. As a result, the joining work becomes complicated.

In addition, since the cross-sectional shape of the bundle 2 of the conductor 1 is varied when the first ultrasonic joining is performed, it is necessary to set joining conditions in accordance with the cross-sectional shape thereof when performing the second ultrasonic joining.

Further, since the second ultrasonic joining is performed, there is a risk that the conductors 1 joined by the first ultrasonic joining are peeled and thus the joining strength is decreased.

The present invention has been made to solve the above-described problems and an object of the present invention is to provide a wire end joining method capable of joining the conductors of the plurality of wires with high joining strength in an extremely easy and reliable manner.

Solution to Problem

In order to achieve the object, the wire end joining method according to the present invention is characterized by the following feature (1) or (2).

(1) A wire end joining method for integrally joining conductors to each other by applying ultrasonic vibration in a predetermined direction to a conductor bundle obtained by bundling the conductors exposed from a plurality of wires, the wire end joining method comprising:

a conductor bundle forming process for forming the conductor bundle by bundling the conductors while interposing metallic foils or plates between the conductors adjacent in a predetermined direction which is an applying direction of the ultrasonic vibration; and an ultrasonic joining process for integrally joining the conductors to each other by applying the ultrasonic vibration to the formed conductor bundle while pressing the formed conductor bundle in the predetermined direction.

(2) In the wire end joining method described in above (1), a conductor bundle compressing process for pre-compressing the conductor bundle formed by the conductor bundle forming process in the predetermined direction which is the applying direction of the ultrasonic vibration is carried out, and then the conductor bundle is subjected to an ultrasonic joining process.

(3) In the wire end joining method described in above (1) or (2), the metallic foils or plates have a shape which can temporarily hold the wire placed for the ultrasonic joining.

In the wire end joining method having the configuration of above (1), the conductors are bundled to form the conductor bundle while interposing the metallic foils or plates between the conductors adjacent in the predetermined direction which is the applying direction of the ultrasonic vibration, and the conductor bundle is subjected to the ultrasonic vibration while being pressed in the predetermined direction. Accordingly, the conductors are joined to each other by the ultrasonic vibration and also the conductors and the metallic foils are joined by the ultrasonic vibration, so that the conductor bundle can be firmly integrated.

That is, the conductors of the plurality of wires can be joined in such a way that the conductor bundle is integrated with high strength by a single ultrasonic joining, without performing a complicated work to apply the ultrasonic vibration several times in different directions, in order to integrate the conductor bundle.

In the wire end joining method having the configuration of above (2), since the conductor bundle is pre-compressed in the applying direction of the ultrasonic vibration prior to the ultrasonic joining process, it is possible to further increase the joining strength between the conductors. In addition, since there is no problem that the conductor bundle is loosed during the ultrasonic joining process, it is possible to perform the work smoothly.

In the wire end joining method having the configuration of above (3), since the conductor bundle obtained by bundling the conductors can be temporarily held in the metallic foil or plate, it is possible to efficiently carry out the works involved in the ultrasonic joining.

Advantageous Effects of Invention

According to the present invention, it is possible to provide a wire end joining method capable of joining the conductors of the plurality of wires with high joining strength in an extremely easy and reliable manner.

Hereinabove, the present invention has been briefly described. Furthermore, details of the invention are further clarified by thoroughly reading the following description of the best mode for carrying out the invention with reference to the accompanying drawings.

BRIEF DESCRIPTION OF DRAWINGS

FIG. 9A to FIG. 9C are all perspective views of the wire bundle end.

DESCRIPTION OF EMBODIMENTS

Hereinafter, an example of an embodiment of the present invention will be described with reference to the accompanying drawings.

Figure 1:
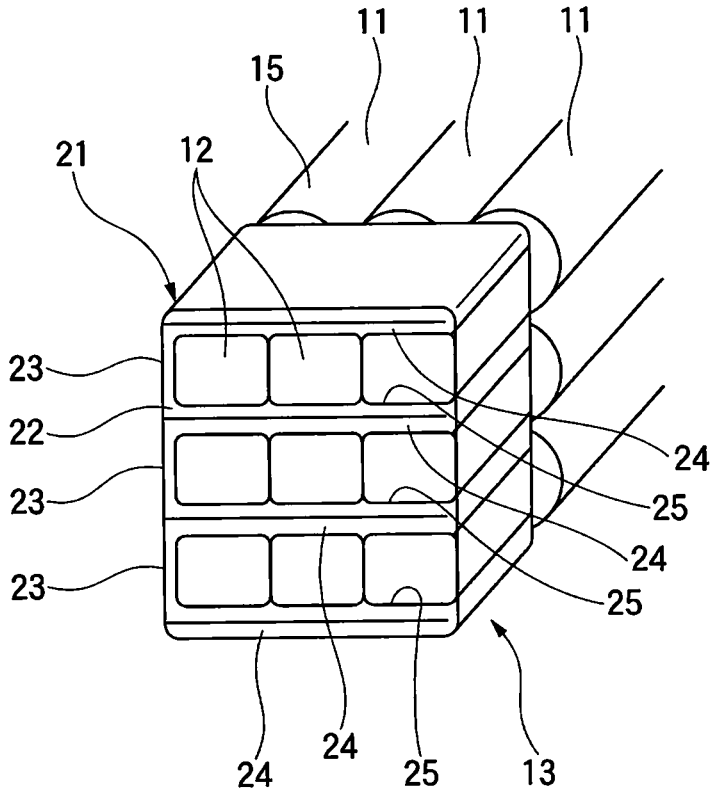
FIG. 1 is a perspective view of a wire bundle end joined by a wire end joining method according to an illustrative embodiment of the present invention.
Figure 2:
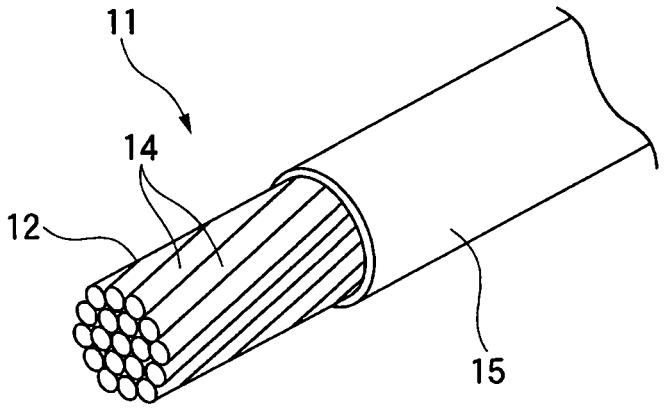
FIG. 2 is a perspective view of a wire end to be joined.
Figure 3:
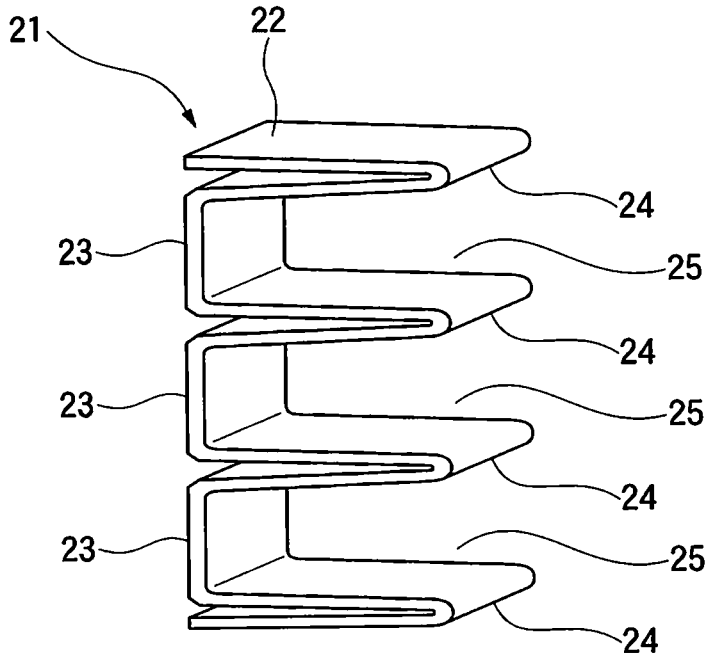
FIG. 3 is a perspective view of a joining metallic member used in joining conductors of wires.

FIG. 1 is a perspective view of a wire bundle end joined by a wire end joining method according to an illustrative embodiment of the present invention. FIG. 2 is a perspective view of a wire end to be joined. FIG. 3 is a perspective view of a joining metallic member used in joining conductors of wires.

As shown in FIG. 1, a plurality of (in the present example, nine) wires 11 is integrated in such a way that respective conductors 12 are bundled at the end to form a conductor bundle 13. The conductor bundle 13 is ultrasonically joined and integrated by applying ultrasonic vibration from a lower side.

As shown in FIG. 2, the wire 11 includes the conductor 12 which is formed by twisting a plurality of strands 14 together. The conductor 12 is covered with an outer sheath 15. The conductor 12 is formed from a metallic material such as aluminum or aluminum alloy, for example. Further, the outer sheath 15 is formed from a synthetic resin material such as polypropylene (PP), for example.

The conductor bundle 13 includes a joining metallic member 21. As shown in FIG. 3, the joining metallic member 21 is formed from a metallic foil 22 which is made of a metallic material such as aluminum or aluminum alloy, for example. The joining metallic member 21 is formed by bending the metallic foil 22 and includes connection parts 23 and a plurality of joining parts 24 extending laterally from the connection parts 23. Conductor receiving spaces 25 are formed between the joining parts 24 of the joining metallic member 21. Three conductors 12 of the wires 11 can be respectively accommodated in the conductor receiving space 25. The conductor receiving space 25 is formed in three stages. And, the joining metallic member 21 is configured so that the joining parts 24 are arranged between the conductors 12 adjacent in a direction (an up-down direction in FIG. 1) perpendicular to a direction of the ultrasonic vibration in which the ultrasonic vibration is applied. As a result, the conductors 12 can be temporarily held in the joining metallic member 21.

Next, each process in a method of integrally joining the conductors 12 of the plurality of wires 11 will be described.

Figure 4:
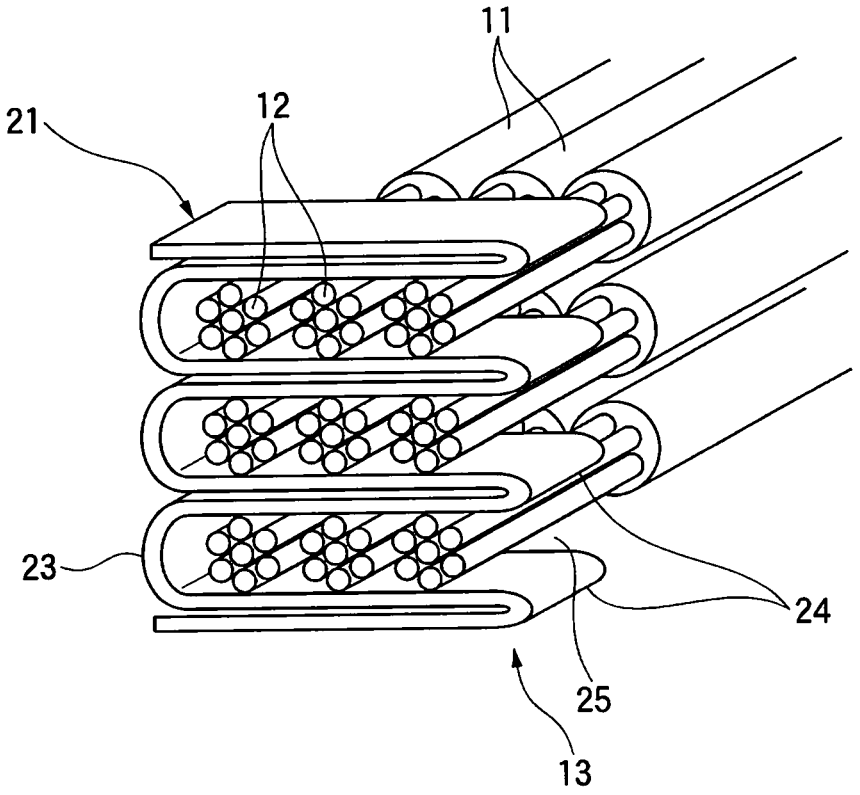
FIG. 4 is a perspective view of the wire bundle end for explaining a conductor bundle forming process.
Figure 5:
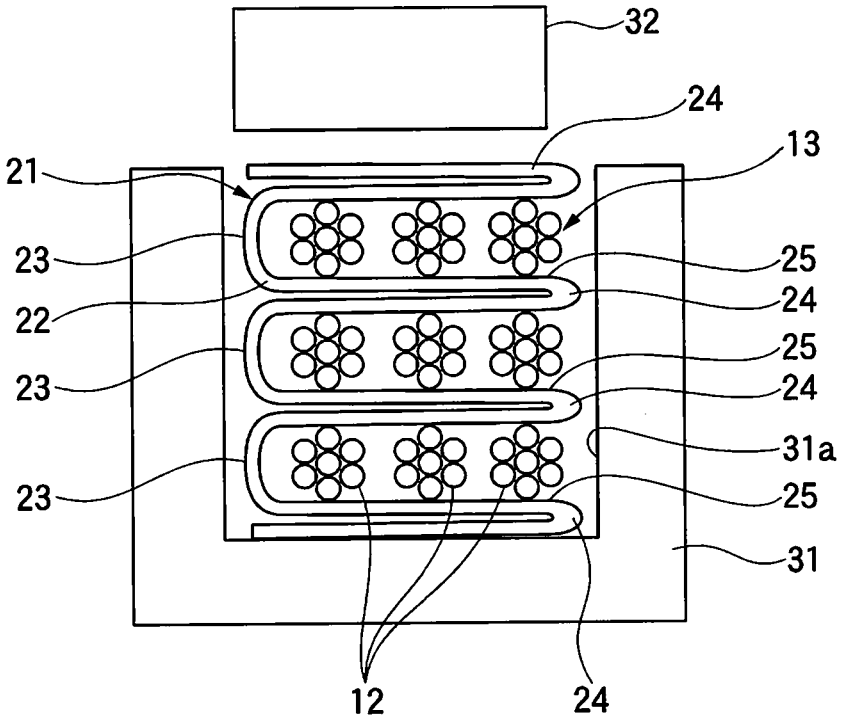
FIG. 5 is a front view of the wire bundle end for explaining a conductor bundle compressing process.
Figure 6:
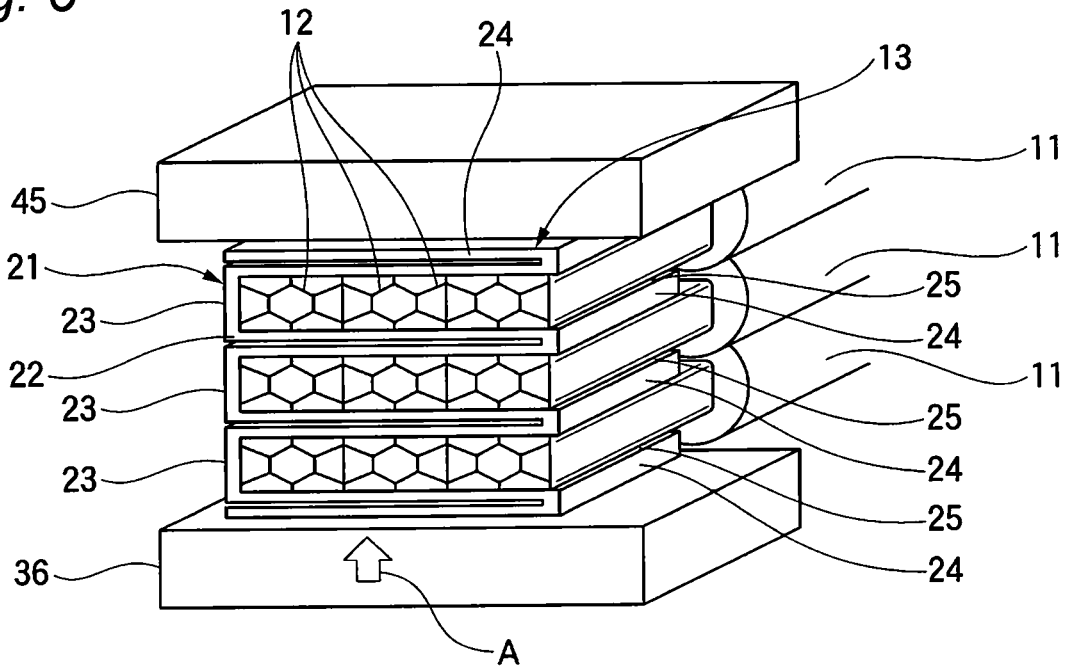
FIG. 6 is a perspective view of the wire bundle end for explaining an ultrasonic joining process.

FIG. 4 is a perspective view of the wire bundle end for explaining a conductor bundle forming process. FIG. 5 is a front view of the wire bundle end for explaining a conductor bundle compressing process. FIG. 6 is a perspective view of the wire bundle end for explaining an ultrasonic joining process.

(Conductor Bundle Forming Process)

First, the conductors 12 of the plurality of wires 11 are exposed by removing the outer sheath 15 at an end of the wires 11.

Next, as shown in FIG. 4, the conductor bundle 13 composed of the conductors 12 and the joining metallic member 21 is formed by accommodating the conductors 12 of the plurality of wires 11 into the conductor receiving spaces 25 of the joining metallic member 21. In this way, the joining parts 24 of the joining metallic member 21 made of the metallic foil 22 are disposed between the conductor receiving spaces 25 accommodating the conductors 12. That is, a state where the metallic foil 22 is interposed between the conductors 12 is achieved.

(Conductor Bundle Compressing Process)

After the conductor bundle 13 is formed, the conductor bundle 13 is inserted into a concave part 31*a* formed in a lower mold 31, as shown in FIG. 5. And then, the conductor bundle 13 in the concave part 31*a* of the lower mold 31 is compressed and molded by an upper mold 32 in the same direction as the direction in which ultrasonic vibration is applied.

(Ultrasonic Joining Process)

After the conductor bundle 13 is compressed and molded, an anvil 45 is placed at an upper part of the conductor bundle 13, as shown in FIG. 6. And then, an ultrasonic horn 36 is placed from a lower side of the conductor bundle 13 and the ultrasonic vibration is applied to the conductor bundle 13 while pressing the conductor bundle 13 by the ultrasonic horn 36.

In this manner, the ultrasonic vibration is applied in a predetermined direction (a direction of arrow A in FIG. 6) from the ultrasonic horn 36 toward the anvil 45. Thereby, the conductors 12 in the conductor receiving space 25 are joined to each other by the ultrasonic vibration and simultaneously the conductors 12 are ultrasonically joined to the joining parts 24 of the joining metallic member 21. By doing so, the conductors 12 of each wire 11 are reliably joined to each other.

In this way, according to the above embodiment, the conductors 12 are bundled to form the conductor bundle 13 while interposing the joining parts 24 of the joining metallic member 21 made of the metallic foil 22 between the conductors 12 adjacent in a predetermined direction which is an applying direction of the ultrasonic vibration, and the conductor bundle 13 is subjected to the ultrasonic vibration while being pressed in the predetermined direction. Accordingly, the conductors 13 are joined to each other by the ultrasonic vibration and also the conductors 13 and the joining parts 24 of the joining metallic member 21 made of the metallic foil 22 are joined by the ultrasonic vibration, so that the conductor bundle 13 can be firmly integrated.

That is, the conductors 12 of the plurality of wires 11 can be joined in such a way that the conductor bundle 13 is integrated with high strength by a single ultrasonic joining, without performing a complicated work to apply the ultrasonic vibration several times in different directions, in order to integrate the conductor bundle 13.

Further, since the conductor bundle 13 is pre-compressed in the applying direction of the ultrasonic vibration prior to the ultrasonic joining process, it is possible to further increase the joining strength between the conductors 12. In addition, since there is no problem that the conductor bundle 13 is loosed during the ultrasonic joining process, it is possible to perform the work smoothly.

Here, the joining metallic member 21 made of the metallic foil 22 is appropriately changed in accordance with the number of the conductors 12 to be joined to each other, etc.

Figure 7:
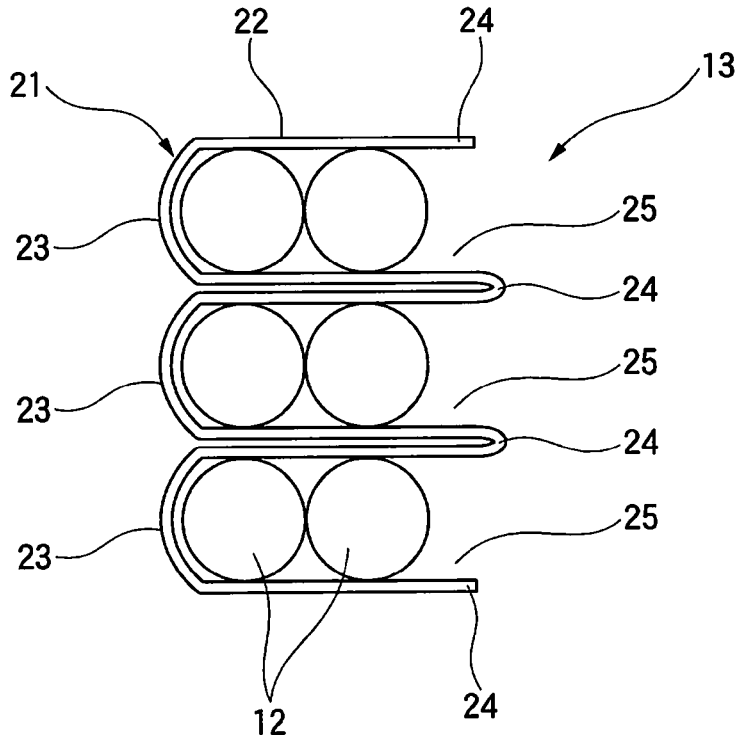
FIG. 7 is a front view showing another example of the joining metallic member used in joining the conductors of the wires.

The joining metallic member 21 used in joining the conductors 12 of six wires 11 is shown in FIG. 7. In this joining metallic member 21, two conductors 12 can be accommodated in each of the conductor receiving space 25 of three stages with one end opened.

By using this joining metallic member 21, the conductors 12 of six wires 11 can be ultrasonically joined and thus firmly integrated.

Figure 8:
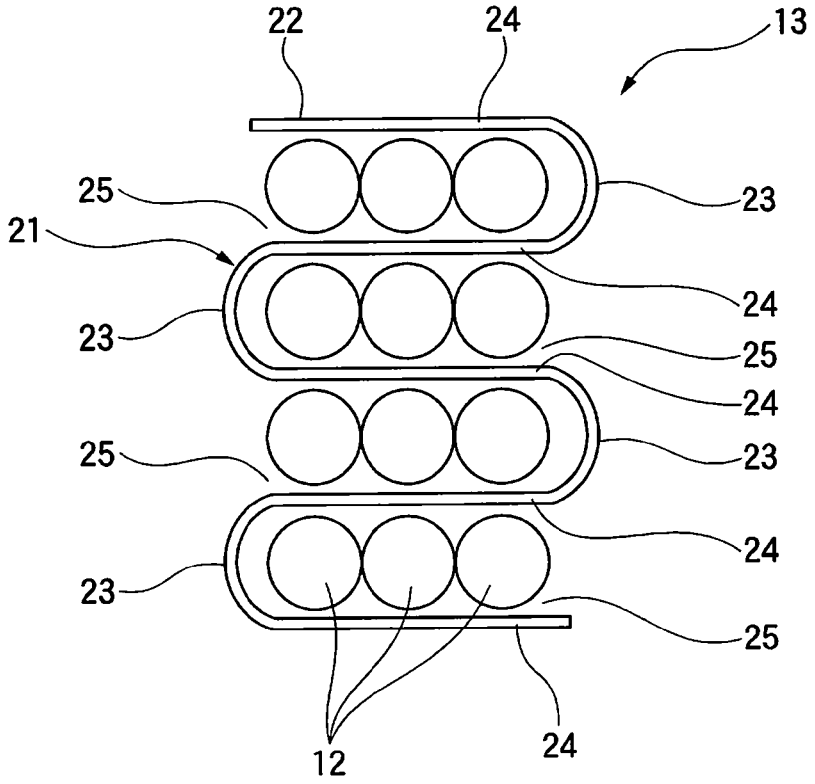
FIG. 8 is a front view showing another example of the joining metallic member used in joining the conductors of the wires.
Figure 9C:
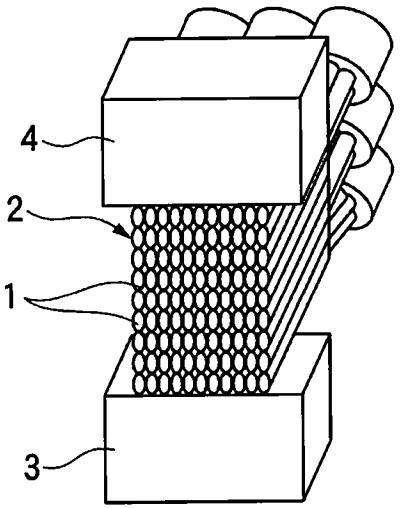
FIGS. 9A to 9C are views for explaining a conventional wire end joining method by an ultrasonic joining method.
Figure 9B:
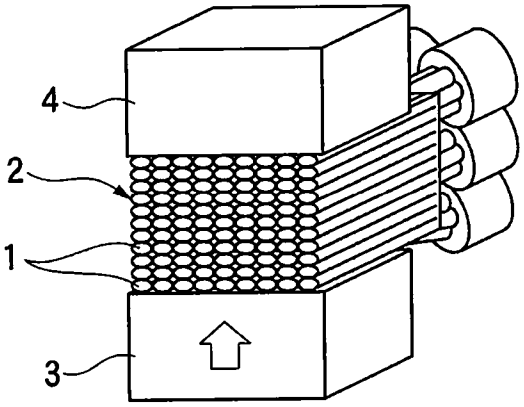
Figure 9A:
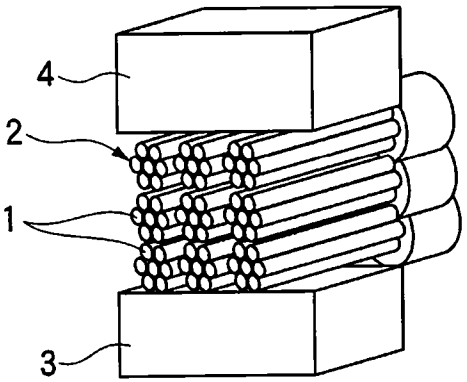

Further, the joining metallic member 21 used in joining the conductors 12 of twelve wires 11 is shown in FIG. 8. The joining metallic member 21 is formed with the conductor receiving space 25 of four stages open in different directions by alternatively folding the metallic foil 22 at both sides. In this joining metallic member 21, three conductors 12 can be accommodated in each of the conductor receiving space 25.

By using this joining metallic member 21, the conductors 12 of twelve wires 11 can be ultrasonically joined and thus firmly integrated.

Meanwhile, the present invention is not limited to the above-described embodiments and suitable modifications, improvements or the like can be made. In addition, the material, shape, dimension, number and arrangement of each component in the above-described embodiments are not limited but can be arbitrarily set, as long as they can achieve the present invention. For example, a metallic plate may be used, instead of the metallic foil used in the above-described embodiments.

Although the present invention has been explained in detail with reference to the particular embodiment, it is obvious for those skilled in the art that various variations and modifications can be applied without departing a spirit and a scope of the present invention.

This application is based upon Japanese Patent Application No. 2010-192422 filed on Aug. 30, 2010 and the entire contents of which are incorporated herein by way of reference.

INDUSTRIAL APPLICABILITY

According to the wire end joining method of the present invention, such advantages can be achieved that it is possible to join the conductors of the plurality of wires with high joining strength in an extremely easy and reliable manner.

REFERENCE SIGNS LIST

11 Wire
12 Conductor
13 Conductor Bundle
22 Metallic foil
A Predetermined direction

The invention claimed is:

1. A wire end joining method for integrally joining two or more conductors to each other by applying ultrasonic vibration in a predetermined direction to a conductor bundle obtained by bundling the two or more conductors exposed from a plurality of wires, the wire end joining method comprising:

a conductor bundle forming process for forming the conductor bundle by bundling the two or more conductors while interposing metallic foils or plates between the two or more conductors adjacent in a predetermined direction which is an applying direction of the ultrasonic vibration, wherein the metallic foils or plates include two or more respective conductor receiving spaces into which the two or more conductors are respectively accommodated; and an ultrasonic joining process for integrally joining the two or more conductors to each other by applying the ultrasonic vibration to the formed conductor bundle while pressing the formed conductor bundle in the predetermined direction.

2. The wire end joining method according to claim 1, further comprising:

a conductor bundle compressing process for pre-compressing the conductor bundle formed by the conductor bundle forming process in the predetermined direction which indicates both the applying direction of the ultrasonic vibration and a pressing direction when the ultrasonic vibration is applied is carried out, and then the conductor bundle is subjected to an ultrasonic joining process.

3. The wire end joining method according to claim 1, wherein the metallic foils or plates have a shape which can temporarily hold the wire placed for the ultrasonic joining.

4. The wire end joining method according to claim 1, wherein each of the two or more conductors are respectively formed by twisting a plurality of strands together.

* * * * *